US010596816B2

(12) United States Patent
Kasai

(10) Patent No.: US 10,596,816 B2
(45) Date of Patent: Mar. 24, 2020

(54) LIQUID EJECTION HEAD SUBSTRATE AND LIQUID EJECTION HEAD

(71) Applicant: CANON KABUSHIKI KAISHA, Tokyo (JP)

(72) Inventor: Ryo Kasai, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/009,440

(22) Filed: Jun. 15, 2018

(65) Prior Publication Data

US 2019/0001677 A1 Jan. 3, 2019

(30) Foreign Application Priority Data

Jun. 29, 2017 (JP) ..... 2017-127791

(51) Int. Cl.
*B41J 2/14* (2006.01)
*B41J 2/045* (2006.01)

(52) U.S. Cl.
CPC ..... *B41J 2/14072* (2013.01); *B41J 2/0458* (2013.01); *B41J 2/04541* (2013.01); *B41J 2/1404* (2013.01); *B41J 2/14088* (2013.01); *B41J 2/14129* (2013.01); *B41J 2002/14467* (2013.01); *B41J 2202/18* (2013.01)

(58) Field of Classification Search
CPC .... B41J 2/04541; B41J 2/0458; B41J 2/1404; B41J 2/14088; B41J 2/14129; B41J 2/14072; B41J 2/05; B41J 2/38; B41J 2/04596; B41J 2/04528; B41J 2/04523; B41J 2/04531; B41J 2002/14491
See application file for complete search history.

(56) References Cited

U.S. PATENT DOCUMENTS 6,234,599 B1 * 5/2001 Ishinaga et al. ..... 347/17
9,039,126 B2 5/2015 Hirayama et al.
(Continued)

FOREIGN PATENT DOCUMENTS

JP 2014-200972 A 10/2014

OTHER PUBLICATIONS

Pending U.S. Appl. No. 16/019,714, filed Jun. 27, 2018 (available on USPTO system).

*Primary Examiner* — Juanita D Jackson
(74) *Attorney, Agent, or Firm* — Venable LLP

(57) ABSTRACT

A liquid ejection head substrate has heating unit and an element array in which a plurality of ejection energy generating elements generating ejection energy for liquid ejection are arranged on a surface side of a base material. The heating unit includes a heating element extending in a direction of the element array and generating heat by being energized, wiring spaced apart from the heating element in a direction orthogonal to the surface of the base material, and a plurality of connecting portions connecting the heating element and the wiring to each other. The heating element, the wiring, and the plurality of connecting portions are provided in a region overlapping a region where the element array is disposed in a direction orthogonal to the direction of the element array when seen from the direction orthogonal to the surface of the base material. A current flows to the wiring in a middle of a path of the current flowing through the heating element when the heating element is energized.

20 Claims, 10 Drawing Sheets

(56) References Cited

U.S. PATENT DOCUMENTS

| | | | | |
|---|---|---|---|---|
| 9,597,893 | B2 | 3/2017 | Kudo et al. | |
| 2009/0315952 | A1* | 12/2009 | Hatsui et al. | B41J 2/14072 |
| 2010/0123971 | A1* | 5/2010 | Kudo et al. | B41J 2/14072 |
| 2014/0300660 | A1 | 10/2014 | Hirayama et al. | |
| 2015/0062252 | A1* | 3/2015 | Fujii et al. | B41J 2/14072 |
| 2016/0214384 | A1 | 7/2016 | Kasai et al. | |

* cited by examiner

LIQUID EJECTION HEAD SUBSTRATE AND LIQUID EJECTION HEAD

BACKGROUND OF THE INVENTION

Field of the Invention

The present invention relates to a liquid ejection head substrate and a liquid ejection head provided with an ejection energy generating element for ink ejection.

Description of the Related Art

A print head substrate in which a plurality of ejection ports for ink ejection are arranged along a predetermined direction is disposed in an inkjet print head (hereinafter, also simply referred to as a print head) provided in an inkjet printing apparatus. An ejection energy generating element for ink ejection is provided for each of the plurality of ejection ports of the print head substrate (hereinafter, also simply referred to as a substrate), and ink in the ejection port is ejected in the form of droplets by the ejection energy generating element being driven. Although it is desirable that the amounts of the ink droplets ejected from the respective ejection ports and the speeds of the ejection are uniform, the amounts and the speeds may vary depending on substrate temperature. In other words, in a case where temperature distribution occurs in the substrate, the temperature distribution may generate image unevenness to result in image quality deterioration.

Disclosed in Japanese Patent Laid-Open No. 2014-200972 as a technique for temperature distribution correction for print head substrates is a method for uniformly adjusting the temperature of a print head substrate by providing a plurality of sub heaters for substrate and ink temperature adjustment and heating the sub heater (heating element) that is positioned in a low-temperature area. Accordingly, for a desired area on the substrate to be uniformly heated, a heating resistor generating heat by being energized needs to be arranged as a sub heater from one end portion to the other end portion of the area. In other words, the length of the sub heater is determined by the length of the area. As a result, the width of the sub heater needs to be adjusted for the heating value of the sub heater to be set to a desired amount. For example, the sub heater has a heating value W of V^2/R in a case where a constant voltage V is applied to the sub heater with a resistance value R. Therefore, the electric resistance R of the sub heater needs to be reduced for the heating value of the sub heater to be raised.

However, in the related art, the electric resistance of the sub heater is kept to a minimum by the area of the sub heater being increased based on an increase in the width of the sub heater. This results in an increase in substrate area and an increase in the size of the print head, which in turn leads to problems such as a decline in the degree of freedom in terms of sub heater arrangement and more constraints in terms of print head substrate design.

SUMMARY OF THE INVENTION

An object of the invention is to allow ink flowing through a substrate to be heated at a desired heating value with the area of heating element installation suppressed and suppress an increase in substrate area and an increase in the size of a print head.

A liquid ejection head substrate according to the present invention including: a base material; an element array in which a plurality of ejection energy generating elements generating ejection energy for liquid ejection are arranged on a surface side of the base material; and heating unit, wherein the heating unit includes a heating element extending in a direction of the element array and generating heat by being energized, wiring spaced apart from the heating element in a direction orthogonal to the surface of the base material, and a plurality of connecting portions connecting the heating element and the wiring to each other, and wherein the heating element, the wiring, and the plurality of connecting portions are provided in a region overlapping a region where the element array is disposed in a direction orthogonal to the direction of the element array when seen from the direction orthogonal to the surface of the base material and a current flows to the wiring in a middle of a path of the current flowing through the heating element when the heating element is energized.

With the invention, ink flowing through a substrate can be heated at a desired heating value with the area of heating element installation suppressed, and thus an increase in substrate area and an increase in the size of a print head can be suppressed.

Further features of the present invention will become apparent from the following description of exemplary embodiments with reference to the attached drawings.

DESCRIPTION OF THE EMBODIMENTS

Hereinafter, embodiments of the invention will be described with reference to accompanying drawings. Incidentally, the embodiments to be described below are examples of a specific form to which the invention is applied and can be appropriately modified or changed depending on the configuration and various conditions of a device to which the invention is applied within the scope of the invention. Therefore, the invention is not limited to the following embodiments.

First Embodiment

Figure 1A:
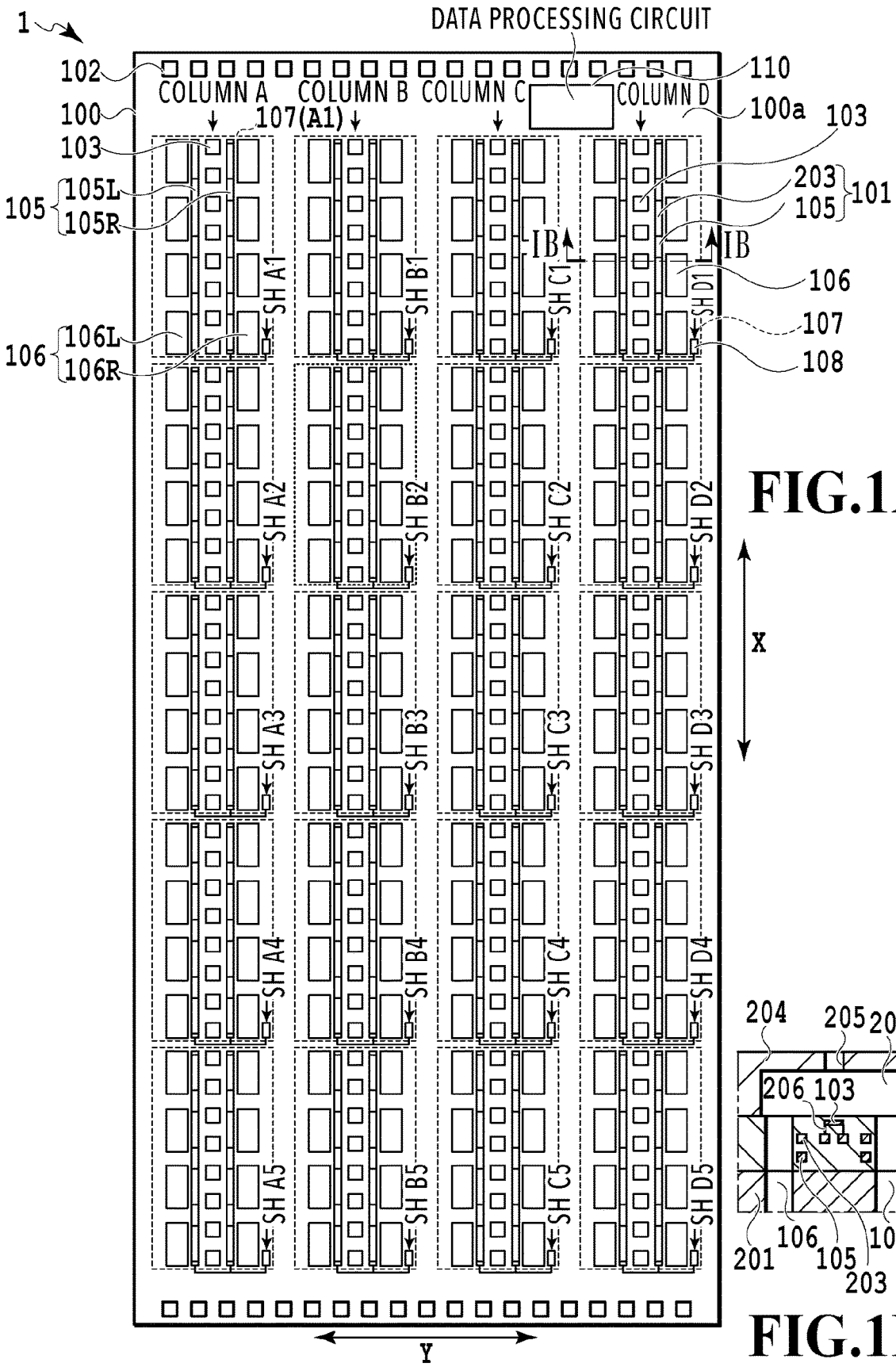
FIGS. 1A and 1B are diagrams illustrating a print head substrate according to a first embodiment.
Figure 1B:
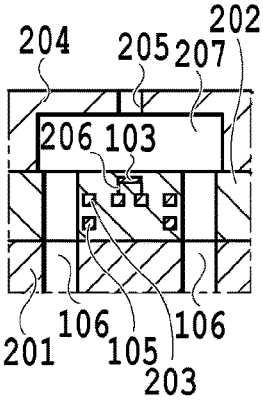

FIGS. 1A and 1B are diagrams illustrating a print head substrate (liquid ejection head substrate) 100 disposed in an inkjet print head as a liquid ejection head according to a first embodiment of the invention. FIG. 1A is a plan view illustrating the layout of each part. FIG. 1B is a longitudinal side view illustrating a part of the print head provided with the print head substrate 100 illustrated in FIG. 1A and is an enlarged sectional view taken along line IB-IB of FIG. 1A.

In the print head substrate 100, print elements 103 as ejection energy generating elements generating ejection energy for ink ejection are arranged at regular intervals along a predetermined direction (X direction). The print elements constitute print element arrays. In the print head substrate 100 illustrated in FIG. 1A, four print element arrays (Column A, Column B, Column C, and Column D) are arranged at different positions in the short side direction (Y direction) that is orthogonal to the long side direction (X direction) of the print head substrate 100. A heating resistor generating heat by being energized constitutes the print element according to the present embodiment. Accordingly, in the following description, the print element 103 will also be referred to as an ejection heater.

An ejection port forming member 204 in which an ejection port 205 for ink ejection is formed is joined to a surface 100*a* of the print head substrate (hereinafter, also simply referred to as a substrate) 100. A flow path 207 is formed between the ejection port forming member 204 and the print head substrate 100. The ejection port 205 is formed at the position in the ejection port forming member 204 that faces the ejection heater 103. Accordingly, an ejection port array is formed at a position corresponding to the print element array.

A plurality of ink supply ports 106 supplying ink to the ejection heaters 103 are arranged along the X direction on both sides (left side and right side in FIG. 1A) of each print element array, and a supply port array is provided as a result. Here, one ink supply port 106 is arranged to the left of two ejection heaters 103 and one ink supply port 106 is arranged to the right of two ejection heaters 103. Once a current is allowed to flow to the heater 103 at any timing, bubbles are generated in the ink by the heat generated from the ejection heater 103, and the pressure that is generated when the bubbles are generated causes the ink in the flow path 207 to be ejected from the ejection port 205 in the form of ink droplets.

A sub heater (heating element) 105 is disposed between the ink supply port 106 and the heater 103 so that the ink supplied from the ink supply port 106 to the ejection heater 103 is preliminarily heated before ejection from the ejection port. In other words, in a plan view of the print element substrate 100, the sub heater 105 is positioned between the print element array and the supply port array and extends along the direction of the print element array. The sub heater 105 is to heat and keep warm the print element substrate 100 and the ink in the print element substrate 100 to the extent that the ink is not foamed. A heating resistor generating heat by a current flowing constitutes the sub heater 105, and the sub heater 105 is connected to a sub heater driver 108. Incidentally, a diffusion resistance material of a poly-Si or Si substrate is capable of constituting the sub heater.

The sub heater driver 108 is provided for each of a plurality of preliminary heating areas determined in the print element substrate 100. A sub heater 105L is arranged between the heater 103 and an ink supply port 106L positioned to the left of the heater 103, and a sub heater 105R is arranged between the heater 103 and an ink supply port 106R positioned to the right of the heater 103. Ink is heated in the vicinity of the heater 103 because of this arrangement, and thus the ink to be ejected can be more efficiently heated.

In the present embodiment, preliminary heating areas 107 are set in 20 places in the print element substrate 100 and the sub heater driver 108 is provided for each preliminary heating area 107. In FIG. 1A, the preliminary heating areas 107 are indicated by dashed lines. The preliminary heating areas 107 in the print head substrate share the same internal sub heater layout. As a result, the sub heaters 105 in the areas have the same heating value and the temperature distribution in the print head substrate 100 can be controlled in a uniform manner. Incidentally, in the following description, the sub heaters 105L and 105R positioned to the left and right of the ejection heater 103 will be collectively referred to as the sub heaters 105 in a case where the sub heaters 105L and 105R do not have to be distinguished from each other.

A plurality of pads 102 are provided in an end portion of the substrate 100. The pads include, for example, a power terminal connected to a power source and a signal terminal for signal input to the ejection heater 103 and the sub heater driver 108.

Figure 2:
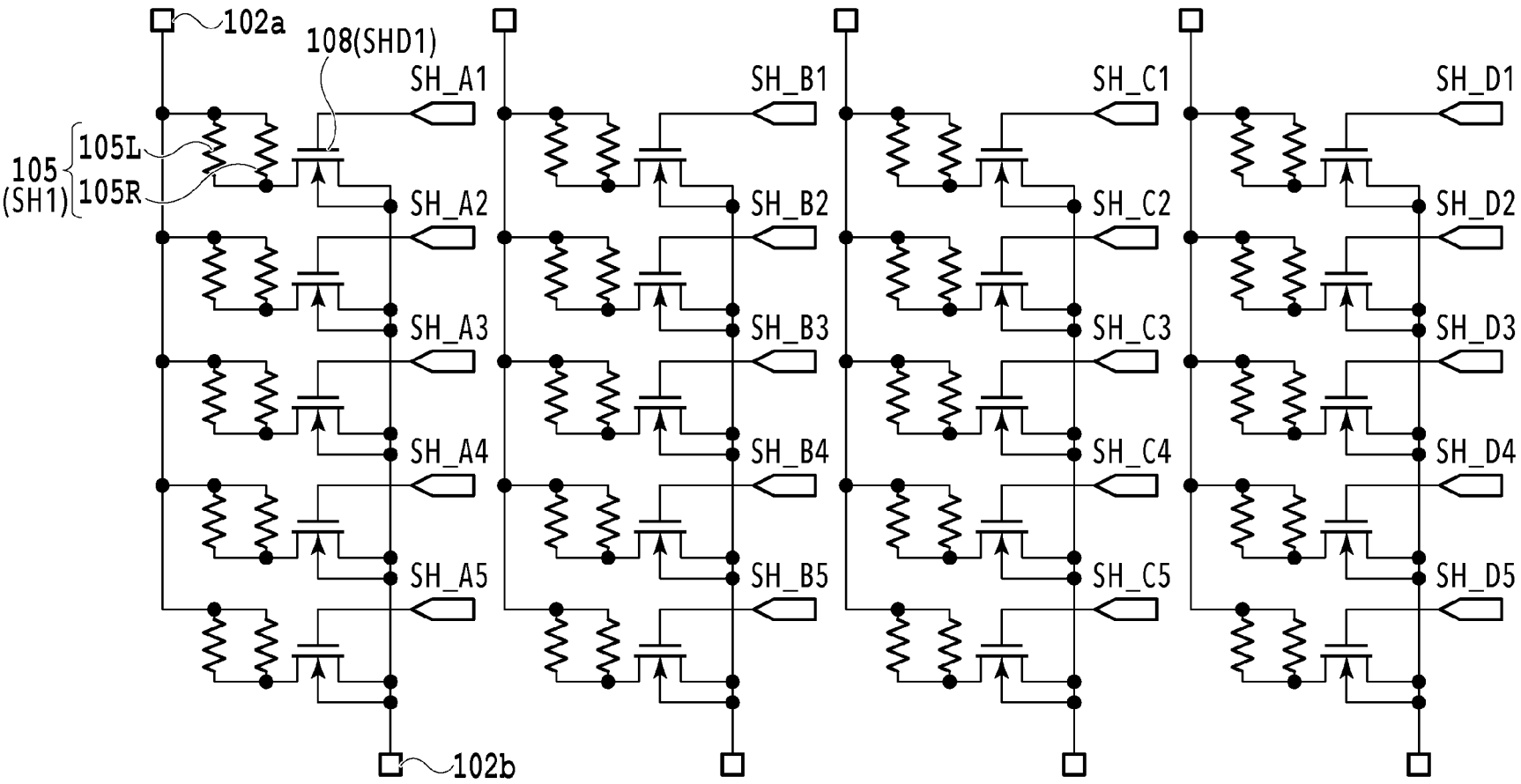
FIG. 2 is a circuit diagram illustrating a drive circuit for driving a sub heater.

FIG. 2 is a circuit diagram illustrating a drive circuit driving the sub heater 105 illustrated in FIGS. 1A and 1B. A pad 102*a* is a plus power pad and a pad 102*b* is a GND pad. The pads 102*a* and 102*b* may also be used along with a power source for the heater 103 used for ink droplet ejection. The sub heater driver 108, controlled by sub heater control signals SH_A1 to SH_D5, is capable of independently heating any of the preliminary heating areas 107 in the 20 places in the print head substrate 100. For example, the sub heater driver 108 is conducted and a current flows to the sub heater 105 (SH1) once the control signal SH_A1 is input to the sub heater driver 108 (SHD1) connected to the sub heater 105 (SH1). As a result, the sub heater 105 (SH1) generates heat and the preliminary heating area 107 (A1) where the sub heater 105 (SH1) is provided is heated. The same applies to the other preliminary heating areas and each of the preliminary heating areas can be heated when the sub heater driver 108 is conducted by a sub heater control signal.

Figure 3B:
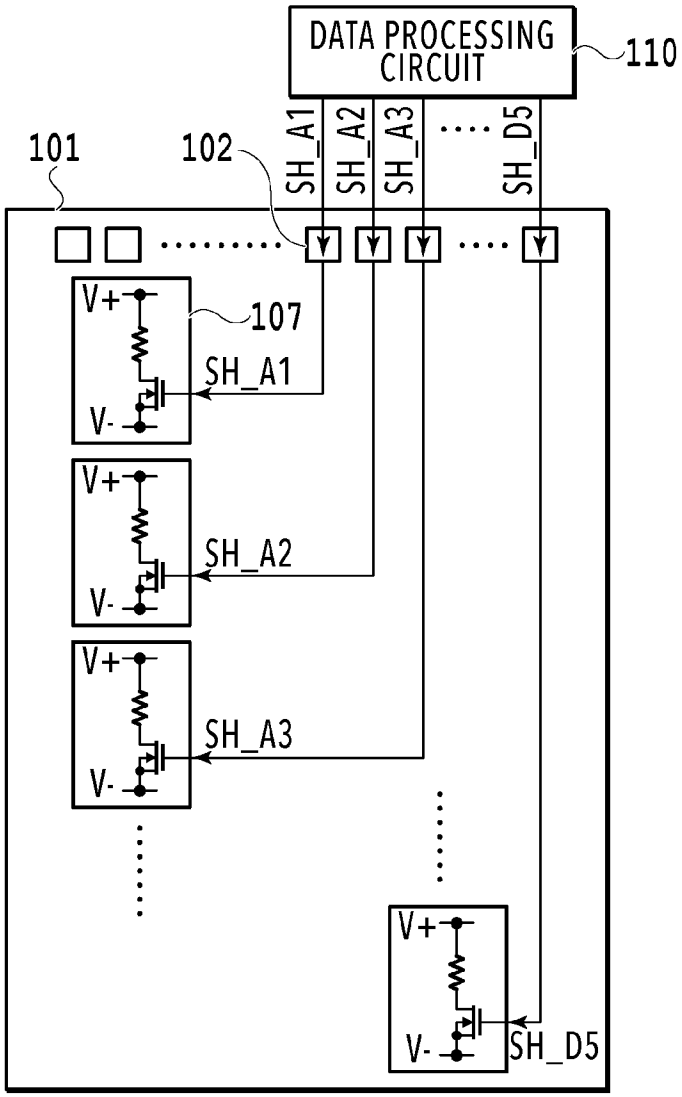
FIGS. 3A and 3B are diagrams illustrating an example of data processing circuit arrangement with respect to a substrate.
Figure 3A:
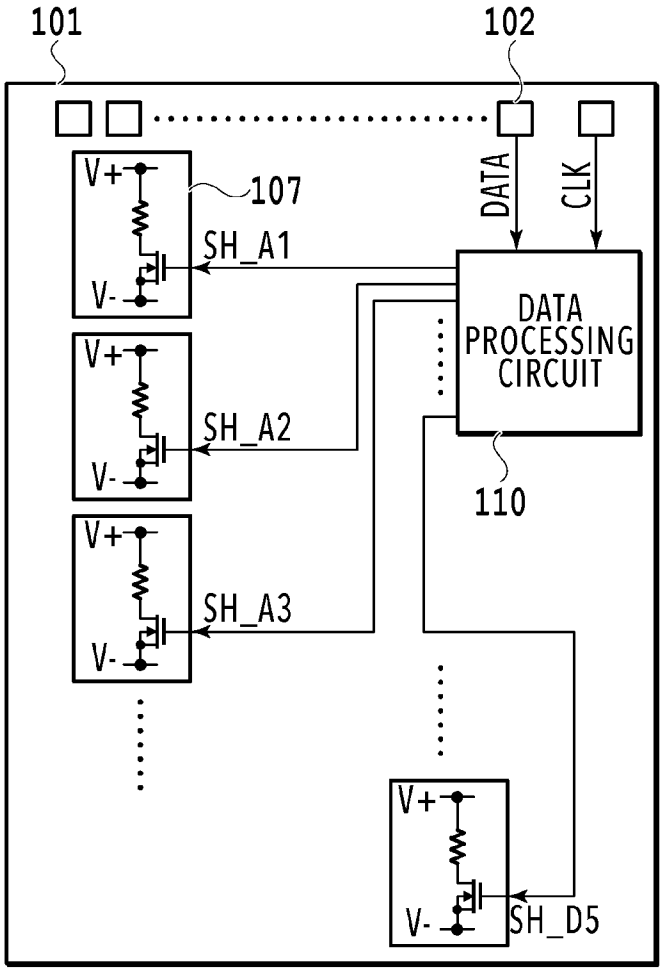

The sub heater control signals SH_A1 to SH_D5 may be directly supplied from the pad 102 to the sub heater driver 108. Alternatively, a sub heater control signal generated by a data processing circuit 110 as control unit in the substrate 100 may be output. FIG. 3A illustrates an example in which the sub heater driver 108 is controlled by the control signals SH_A1 to SH_D5 output from the data processing circuit 110 in the substrate 100. FIG. 3B illustrates a case where the sub heater driver 108 is driven by a control signal directly supplied from the outside of the substrate 100. In the configuration that is illustrated in FIG. 3A, the sub heater 105 can be controlled without the pad 102 being increased when a signal (including a clock signal (CLK) or the like) and image data (DATA) are sent at the same time. In the configuration that is illustrated in FIG. 3B, the substrate 100 can be reduced in size since the data processing circuit 110 is disposed outside the substrate 100.

Figure 4A:
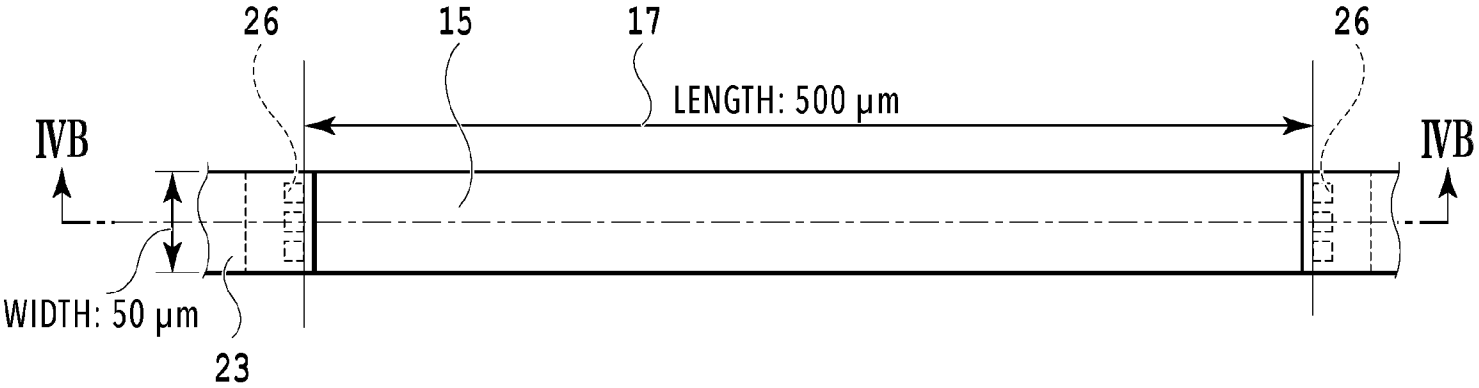
FIGS. 4A and 4B are diagrams illustrating a configuration example of a sub heater disposed in a print head substrate according to a comparative example.
Figure 4B:
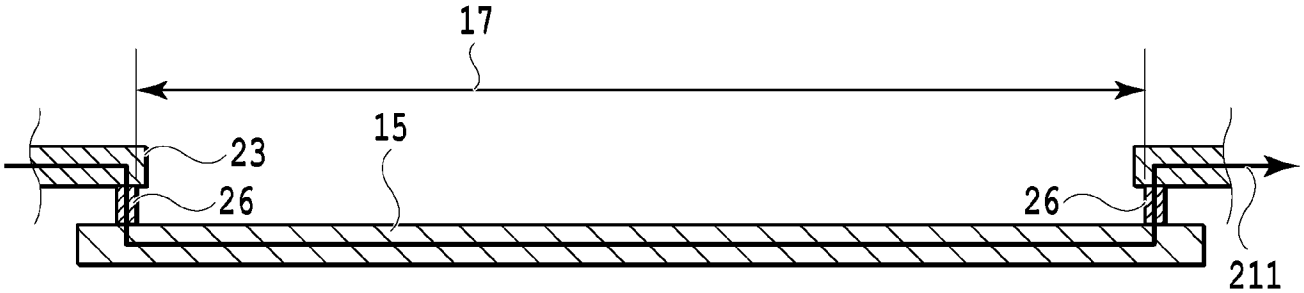
Figure 5A:
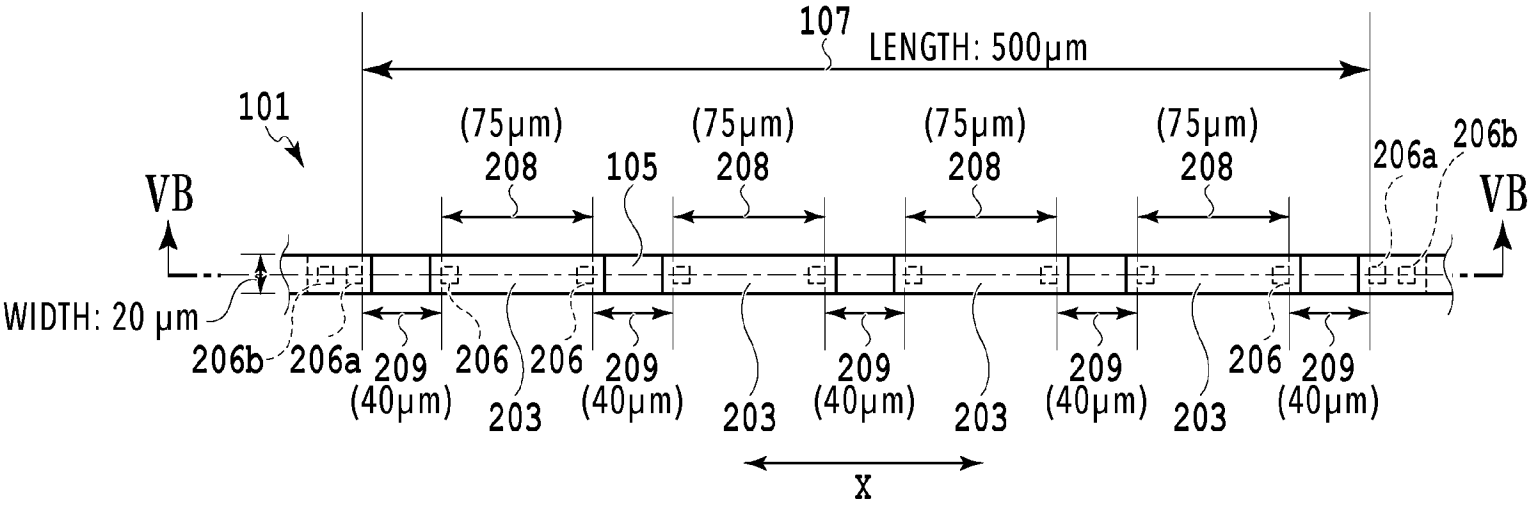
FIGS. 5A and 5B are diagrams illustrating a configuration example of a preliminary heating portion in the print head substrate according to the first embodiment.
Figure 5B:
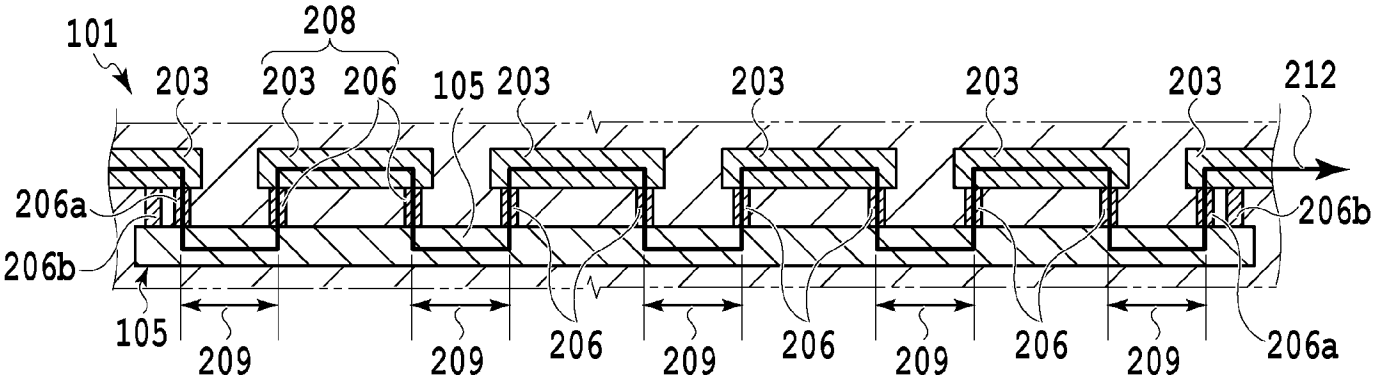

FIGS. 4A and 4B are diagrams illustrating a configuration example of one sub heater 15 disposed in a print head substrate according to a comparative example for an inkjet printing apparatus. FIG. 4A is a plan view and FIG. 4B is a longitudinal sectional view. FIGS. 5A and 5B are diagrams illustrating the configuration of the sub heater 105 provided in one preliminary heating area 107 disposed in the print head substrate 100 according to the present embodiment. FIG. 5A is a plan view and FIG. 5B is a longitudinal sectional view.

The sub heater 15 according to the comparative example that is illustrated in FIGS. 4A and 4B has a constant length and a constant width. Wiring portions 23 for current supply are connected to both end portions of the sub heater 15 via conductor-based plugs 26. Specifically, the length of the sub heater 15 is 500 μm and the width of the sub heater 15 is 50 μm. A poly-Si sheet constitutes the sub heater 15, which has an overall resistance value (R) of 100 Ω. Accordingly, in a case where both ends of the sub heater 15 have a differential voltage of 10 V, a current flows as indicated by an arrow 211 and a heating value W in a preliminary heating area 17 at that time is 10 V^2/100 Ω=1 W.

Meanwhile, a preliminary heating portion 101 (heating unit) including the sub heater 105 according to the present embodiment has, for example, the configuration that is illustrated in FIGS. 5A and 5B. FIG. 5A is a plan view and FIG. 5B is a sectional view taken along line VB-VB of FIG. 5A. The preliminary heating portion 101 illustrated here includes the sub heater 105 and a plurality of current bypass portions 208. In other words, the preliminary heating portion 101 includes four current bypass portions 208 and five heating portions 209 included in the sub heater 105 on the path of the current that flows therethrough. A wiring portion 203 (wiring) based on aluminum wiring (A1 wiring) and a plug 206 (connecting portion) constitute the current bypass portion 208. The sub heater 105 and the wiring portion 203 are provided at different positions in the direction that is orthogonal to the surface of the print element substrate with the sub heater 105 and the wiring connected via the plug 206. In addition, the sub heater 105 and the wiring portion 203 are spaced apart from each other in the direction that is orthogonal to the surface of the print element substrate. The sub heater 105, the wiring portion 203, and the plug 206 are provided in a region overlapping a region where the print element array is disposed in the direction orthogonal to the direction of the print element array when seen from the direction orthogonal to the surface of the base material 201. In other words, in a plan view of the print head substrate 100 as illustrated in FIG. 1A, the sub heater 105, the wiring portion 203, and the plug 206 are provided to overlap the print element array in the Y direction. The combined resistance value thereof is as small as 1/100to 1/1,000of the resistance of the sub heater 105, and the current bypass portion 208 has a calculated resistance value of 0 Ω here. Incidentally, at least one of Al, Cu, Au, Ni, W, Ti, and a compound thereof is capable of constituting the wiring portion 203. W or the like is capable of constituting the plug 206. By the wiring portion 203 exhibiting a low resistance value being connected to the sub heater 105 as described above, the current flowing through the preliminary heating area 107 alternately flows to the sub heater 105 and the current bypass portion 208 as indicated by an arrow 212 in FIG. 5B. In other words, in the sub heater 105, most of the current flows to the part 209 positioned between the adjacent wiring portions 203 and the part 209 becomes a heating portion generating heat. In other words, the wiring portion 203 is connected to both ends of the heating portion 209 of the sub heater 105. In other words, the wiring portion 203 is connected in parallel to the non-heating portion part of the sub heater 105. In this manner, the preliminary heating portion 101 according to the present embodiment is configured such that a current flows to the wiring portion 203 via the plug 206 in the middle of the path of the current flowing through the sub heater 105 when the sub heater 105 is energized.

The present embodiment is configured such that a total electric resistance of 100 Ω is obtained in the five heating portions 209 so that a heating value of 1 W is obtained as is the case with the sub heater 15 illustrated in FIGS. 4A and 4B. The length of the sub heater 105 that is used here is 500 μm as is the case with FIGS. 4A and 4B whereas the width of the sub heater 105 is 20 μm, which is shorter than in the case of FIGS. 4A and 4B. As a result, the sub heater 105 according to the present embodiment realizes the same heating value as the sub heater 15 illustrated in FIGS. 4A and 4B with 40% of the area of the sub heater 15 illustrated in FIGS. 4A and 4B, and thus the sub heater 105 according to the present embodiment realizes area shrinkage for the print head substrate 100.

As illustrated in FIGS. 5A and 5B, the sub heaters 105 according to the present embodiment are in a state where the heat-generating heating portions 209 are dispersed in terms of arrangement with respect to the preliminary heating area 107. However, the heating portions 209 are interconnected by the metal-based low-thermal resistance current bypass portion 208. Accordingly, the heat generated in the heating portion 209 is diffused to the current bypass portion 208 and the preliminary heating area 107 is uniformly heated. In addition, in a case where the preliminary heating area 107 needs to be heated with more uniformity, the length of the current bypass portion 208 may be reduced and the area of the heating portion 209 may be increased with the length-to-width ratio of the heating portion 209 maintained. In this case, however, the area shrinkage effect is reduced. Although the shrinkage effect can be enhanced when the length and the width of the heating portion 209 are reduced and the length of the current bypass portion 208 is increased, this results in an increase in wiring current density, which may lead to disconnection attributable to electromigration or the like.

Figures 6A, 6B, 6C, 6D:
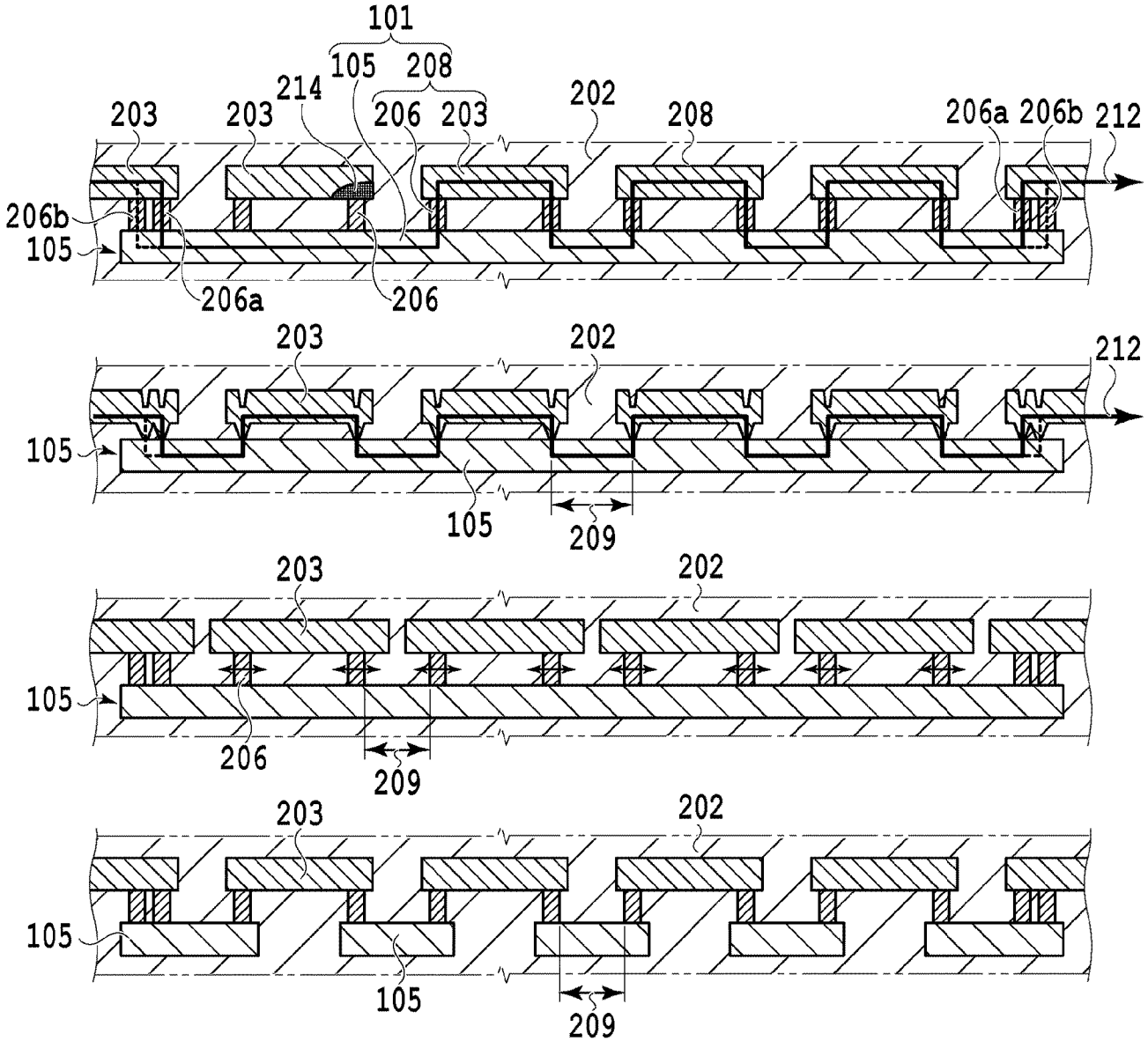
FIG. 6A is a sectional view illustrating the preliminary heating portion.
FIGS. 6B to 6D are sectional views illustrating first to third modification examples of the first embodiment.

FIG. 6A is a diagram illustrating an example in which the sub heater 105 is disconnected due to electromigration. The plug 206 is a low-resistance and current-concentrated plug, and thus electromigration is relatively likely to occur at a contact part 214 between the plug 206 and the AL wiring-based wiring portion 203. Accordingly, measures are taken such as barrier metal interposition between the wiring portion 203 and the plug 206 and current value setting in a range in which disconnection attributable to electromigration normally does not occur. In the present embodiment, however, the sub heater 105 is wired from one end to the other end of the preliminary heating area 107, and thus the current bypasses to the sub heater 105 as indicated by the arrow 212 illustrated in FIG. 6A even if disconnection occurs in the wiring portion 203. Accordingly, even if the disconnection as described above occurs, the sub heater 105 is capable of achieving a highly reliable heating function without losing the heating function thereof. Still, once the disconnection as described above occurs and a part of the wiring portion becomes non-conductive, the heating value is reduced due to an increase in overall resistance value in the preliminary heating area 107. In the present embodiment, single bypass wiring disconnection causes the heating value to fall from 1 W to 0.73 W as illustrated in FIG. 6A.

In addition, in the present embodiment, the sub heater 105 and the wiring portion 203 are interconnected by the plugs 206 (206*a* and 206*b*), which are arranged in two different places in the X direction, at both ends of one sub heater 105 as illustrated in FIGS. 5A, 5B, and 6A. Accordingly, the sub heat function can be maintained even in the event of disconnection. In other words, the sub heater 105 has a high resistance value, and thus the current flows through the low-resistance wiring portion 203. As a result, even when the plugs are arranged in the two places, the current flows to the sub heater 105 mainly through the low-resistance path, that is, the plug 206*a* positioned closer to an end portion of the wiring portion 203 as indicated by the arrow 212 in FIG. 6A. Even if disconnection occurs at the contact part between the plug 206*a* and the wiring portion 203 at this time, the current still flows via the plug 206*b* as indicated by the dashed lines, and thus current supply to the sub heater 105 as a whole is not blocked. Incidentally, illustrated in FIG. 6A is an example in which both end portions of the sub heater 105 and the wiring portion 203 are interconnected by the plug 206 provided in two different places. Alternatively, both end portions of the sub heater 105 and the wiring portion 203 may be interconnected by plugs provided in three different places.

FIGS. 6B to 6D are longitudinal side views illustrating modification examples of the method for interconnecting the sub heater 105 and the wiring portion 203 according to the first embodiment. In the first modification example that is illustrated in FIG. 6B, the wiring portion 203 and the sub heater 105 are directly interconnected without the use of the plug 206 as illustrated in FIG. 6A. This interconnection can be performed by a hole portion penetrating an insulating layer 202 being formed on the sub heater 105 when the insulating layer 202 covering the sub heater 105 is formed and the wiring portion 203 being formed with aluminum on the hole portion-formed insulating layer 202. In other words, aluminum is film-formed in a hole and comes into direct contact with the wiring portion 203 when the wiring portion 203 is formed on the insulating layer 202. By this method, the wiring portion 203 and the sub heater 105 can be electrically interconnected without plug formation and effects similar to those achieved in a case where the plug is used can be anticipated.

The wiring portion 203 constituting the current bypass portion 208 in the second modification example that is illustrated in FIG. 6C is longer than the wiring portion 203 of the current bypass portion 208 that is illustrated in FIG. 6A. Accordingly, in the second modification example, the position where the plug 206 is formed can be adjusted in a wider range, and thus the temperature adjustment range of the heating portion 209 in the sub heater 105 can be widened by the position where the plug 206 is formed being changed. In other words, the length of the heating portion 209 of the sub heater 105 is reduced and the overall electric resistance of the sub heater 105 decreases when the position where the plug 206 is formed is set outside with respect to the wiring portion 203. As a result, the overall heating value of the sub heater 105 is adjusted upward. However, when the position where the plug 206 is formed is set inside with respect to the wiring portion 203, the length of the heating portion 209 of the sub heater 105 is increased and the overall electric resistance of the sub heater 105 increases, and then the overall heating value of the sub heater 105 is adjusted downward. The position where the plug 206 is formed can be realized by changing the design of one mask sheet used during film formation, and thus the manufacturing cost during a change in design of the sub heater 105 can be reduced.

FIG. 6D is a longitudinal side view illustrating a third modification example of the first embodiment. In the third modification example, the sub heater 105 is formed in a state where the sub heater 105 is divided in the preliminary heating area and a plurality of sub heaters 105 are interconnected in series with the wiring portion 203. Also in the third modification example, an appropriate heating amount can be maintained and the area shrinkage effect of the sub heater 105 can be achieved at the same time by wiring portion connection to the sub heater 105.

Figure 7A:
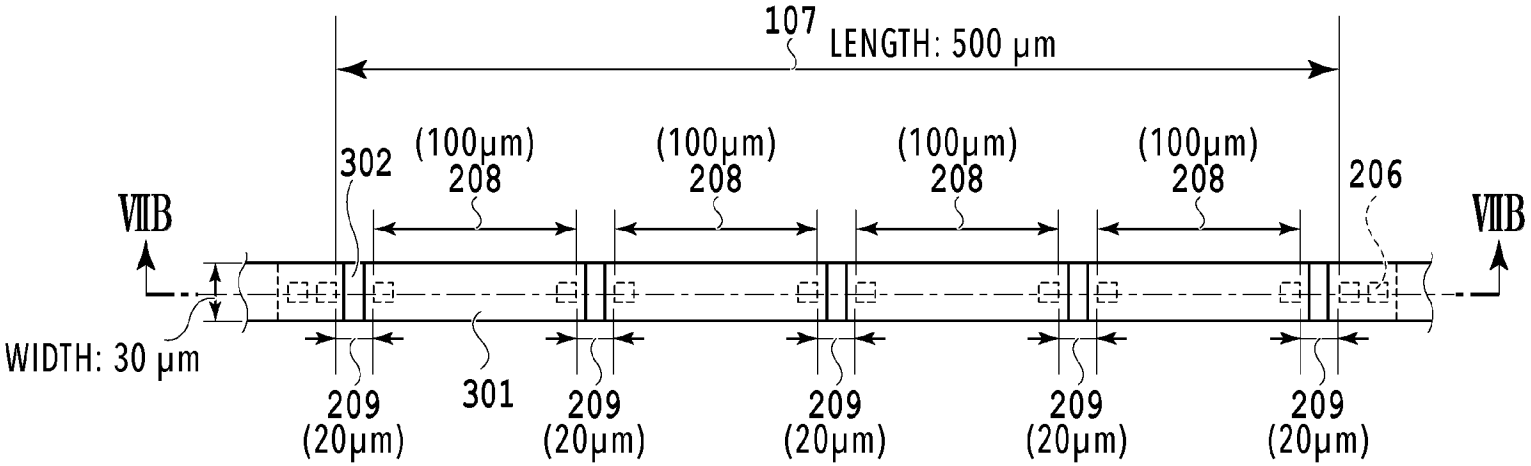
FIGS. 7A and 7B are diagrams illustrating a fourth modification example of the first embodiment.
Figure 7B:
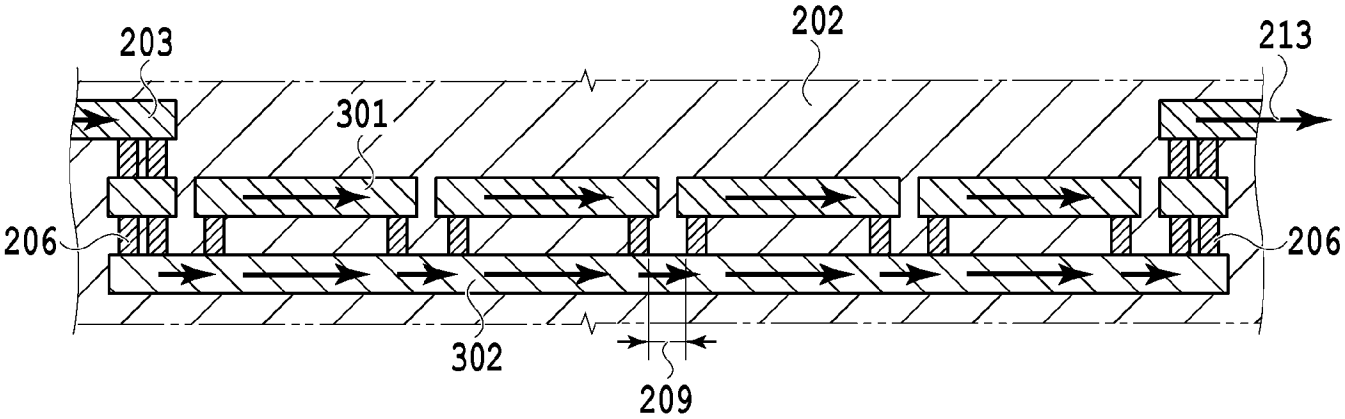

FIGS. 7A and 7B are diagrams illustrating a fourth modification example of the method for interconnecting the sub heater 105 and the wiring portion 203 according to the first embodiment. FIG. 7A is a plan view and FIG. 7B is a sectional view taken along line VIIB-VIIB of FIG. 7A. In the fourth modification example, one poly-Si layer forms a sub heater 302, another poly-Si layer forms a wiring portion 301, and the sub heater 302 and the wiring portion 301 are interconnected with the plug 206 in a substrate formed as a result of a semiconductor process through which the two poly-Si layers are formed. In this manner, the wiring portion 301 and the sub heater 302 according to the fourth modification example are similar to each other in terms of electric resistance, and thus the wiring portion 301 generates heat with the sub heater 302. In other words, the wiring portion 301 and the sub heater 302 function as a heating portion as a whole. The wiring portion 301 is connected in parallel to the sub heater 302 here, and thus the combined resistance value of the wiring portion 301 and the sub heater 302 is significantly less than the electric resistance value of the sub heater 302 as a single unit and a current 213 increases. As a result, also in the fourth modification example, the sub heater area shrinkage effect can still be achieved as in the example that is illustrated in FIG. 6A. In the dimension configuration illustrated in FIG. 7A, for example, the area shrinkage that is realized is ⅗of that of the example illustrated in FIGS. 4A and 4B.

As described above, in the present embodiment, the width (area) of the sub heater 105 can be reduced without a decline in heating value, and thus an increase in the size of the print head substrate 100 and an increase in the size of the print head can be suppressed. In addition, in a case where the sub heater 105 is arranged in the vicinity of the flow path reaching from the ink supply port 106 to the ejection heater 103 so that the ink flowing through the flow path is heated, an increase in the length of the flow path reaching the ejection heater 103 from the ink supply port 106 and an increase in the width of the flow path reaching the ejection heater 103 from the ink supply port 106 can be suppressed. As a result, the ejection heater 103 can be refilled with ink within a shorter period of time after ink ejection, the frequency of ejection can be increased, and printing throughput can be significantly improved.

Second Embodiment

Figure 8A:
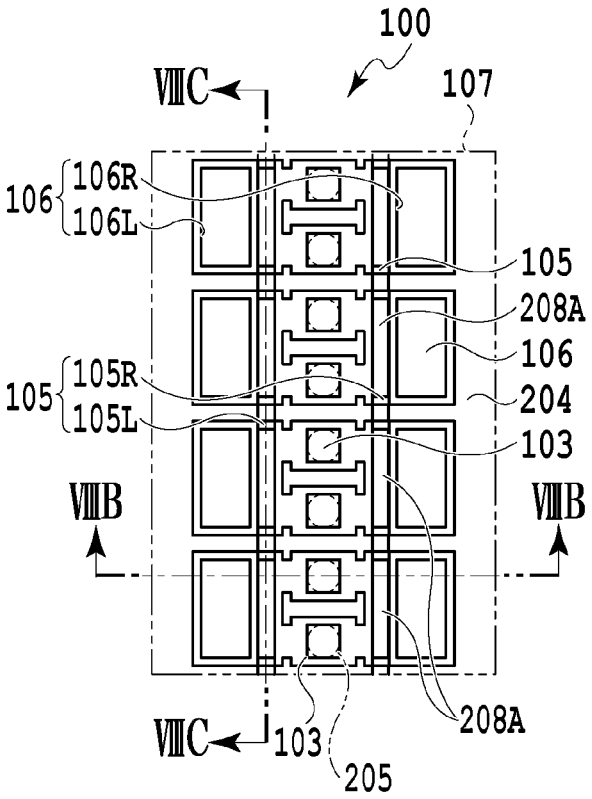
FIGS. 8A to 8C are diagrams illustrating a part of a print head according to a second embodiment.
Figure 8C:
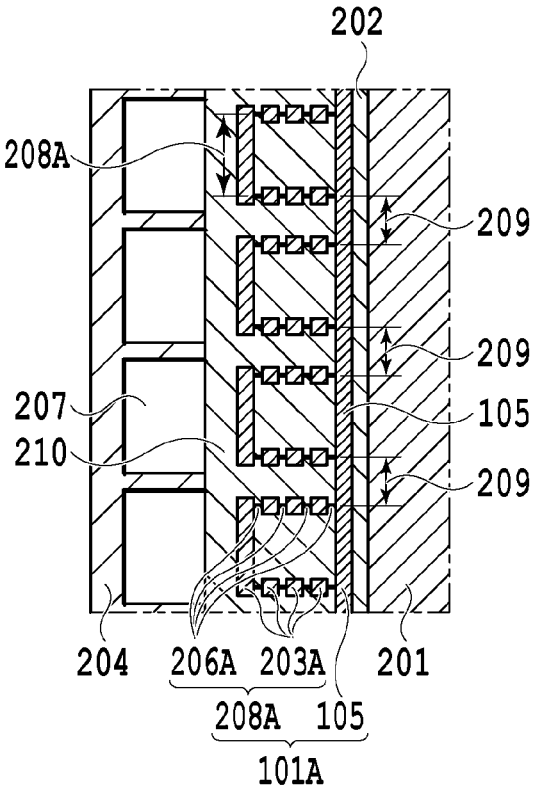
Figure 8B:
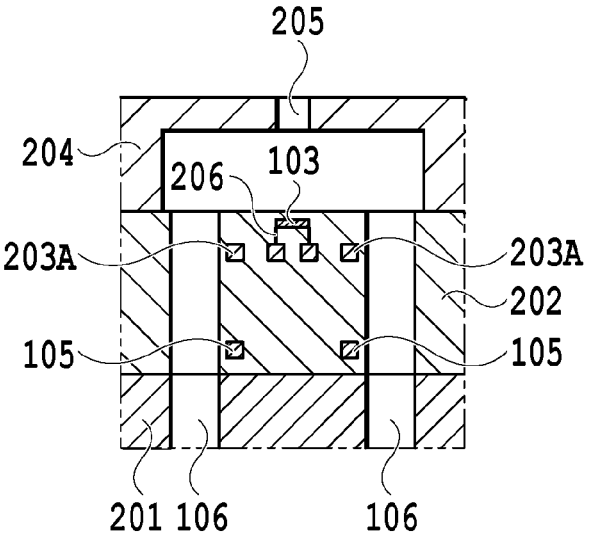

A second embodiment of the invention will be described below. FIGS. 8A to 8C are diagrams illustrating a part of the print head according to the second embodiment. FIG. 8A is a plan view illustrating the layout of each part in the preliminary heating area of the print head substrate. FIG. 8B is a sectional view taken along line VIIIB-VIIIB of FIG. 8A. FIG. 8C is a sectional view taken along line VIIIC-VIIIC of FIG. 8A. Incidentally, in FIGS. 8A to 8C, the same reference numerals are used to refer to parts identical or equivalent to those of the first embodiment.

In the present embodiment, the plurality of preliminary heating areas 107 are set in the print head substrate 100 as is the case with the first embodiment. Each of the preliminary heating areas 107 is configured as illustrated in FIG. 8A. As illustrated in FIG. 8A, a preliminary heating portion 101A is provided in the preliminary heating area 107 so that the substrate and ink are heated and kept warm. Also in the present embodiment, the ink supply ports 106 (106L and 106R) are arranged to the left and right of the ejection heaters 103 in view of the property of ink refill on the ejection heaters 103. The sub heater 105 and a current bypass portion 208A partially connected in parallel to the sub heater 105 constitute the preliminary heating portion 101A. The sub heaters 105 extend in the arrangement direction of the ejection heaters 103. As illustrated in FIG. 8A, the sub heaters 105 are arranged between the ejection heaters 103 and the ink supply ports 106 (106L and 106R). The sub heaters 105 are identical in planar layout to the sub heaters 105 according to the first embodiment. However, the preliminary heating portions 101A according to the present embodiment are different in sectional structure.

As illustrated in FIGS. 8B and 8C, the preliminary heating portion 101A includes the sub heater 105 laminated on the base material 201 via the insulating layer 202 and wiring portions 203A as a plurality of (four in the drawing) layers connected to the sub heater 105 via a plug 206A. Poly-Si wiring forms the sub heater 105. The wiring portions 203A are interconnected via the plug 206A and are respectively connected in parallel to the sub heater 105 at a plurality of parts. The part of the sub heater 105 that is positioned between the adjacent current bypass portions 208A is the heating portion 209.

As illustrated in FIG. 8A, the sub heater 105 is formed in the lower layer portion of the insulating layer 202 laminated on the base material 201 and the ejection heater 103 is formed in the upper layer portion of the insulating layer 202. In other words, the sub heater 105 forming the heating portion 209 is arranged at a position separated from the ejection heater 103. However, it is ideal to perform preliminary heating in the vicinity of the ejection heater 103 for ejected ink to be preliminarily heated. In this regard, in the present embodiment, the current bypass portion 208A connected to the sub heater 105 has a multilayer structure and the uppermost layer portion of the current bypass portion 208A is arranged in the vicinity of both side portions of the ejection heater 103. As a result, the heat that is generated in the heating portion 209 of the sub heater 105 arranged in the lower layer can be transferred to an upper layer portion 210 via the plug 206A and the wiring portion 203A forming a multilayer structure and ink can be heated in the vicinity of the ejection heater 103. Accordingly, the viscosity of the ink in the vicinity of the ejection heater 103 can be reduced, ink refill on the ejection heater 103 can be accelerated, and printing throughput can be improved. In addition, the ink, which exhibits a high viscosity at a normal temperature, can be better ejected, and thus the degree of freedom can be raised in terms of image quality improvement and ink selection. As a result, multipurpose deployment of the print head becomes possible.

In addition, in the second embodiment, the area shrinkage effect of the sub heater 105 can be achieved as in the first embodiment. The area shrinkage effect of the sub heater 105 results in a decrease in the size of the print head substrate and contributes, in turn, to a decrease in the size of the printing apparatus.

Incidentally, the substrate illustrated in FIG. 1A can be used in print heads for ejecting the same type of ink (such as inks of the same color). Alternatively, the substrate illustrated in FIG. 1A can be used in print heads ejecting different types of inks. For example, the print element arrays of Columns A to D can be used for ejection of inks of different colors such as yellow, cyan, magenta, and black, respectively. In addition, each of the print element arrays can be used for ejection of the same type of ink.

Third Embodiment

Figure 9A:
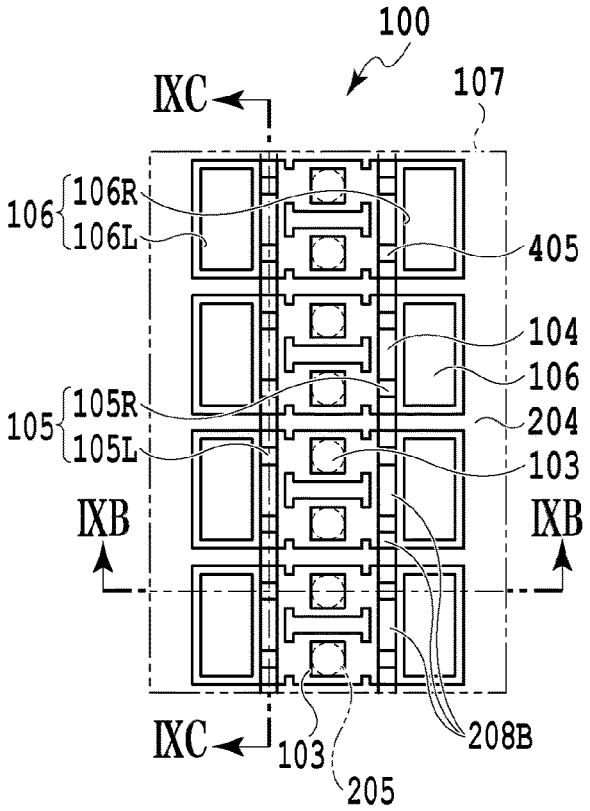
FIGS. 9A to 9C are diagrams illustrating a part of a print head according to a third embodiment.
Figure 9C:
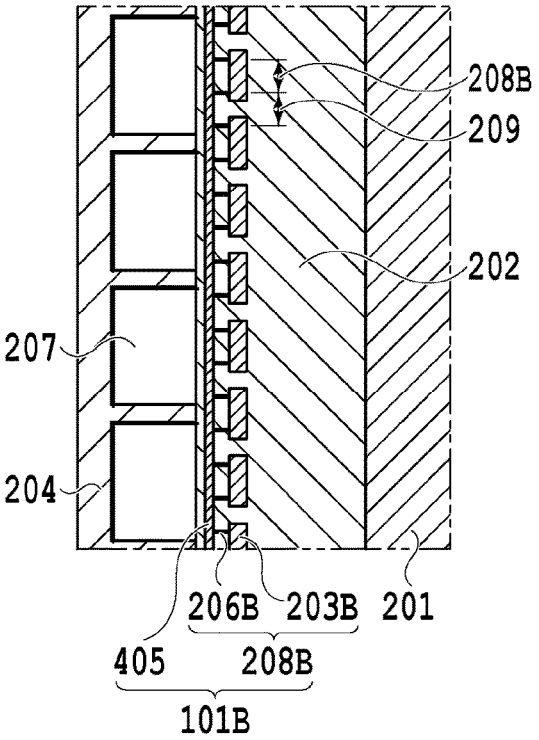
Figure 9B:
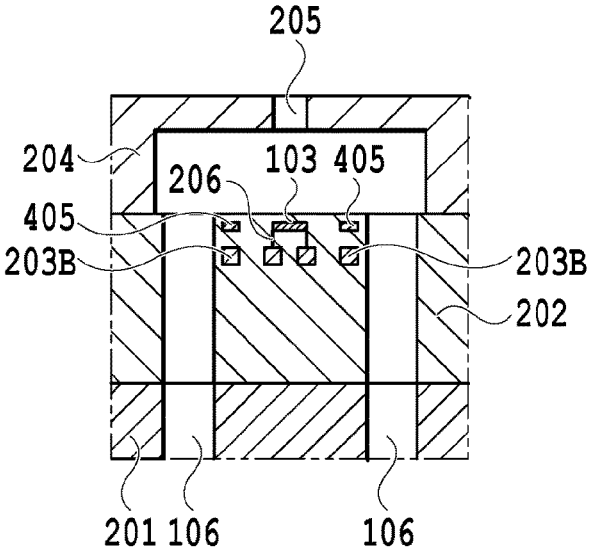

A third embodiment of the invention will be described below. FIGS. 9A to 9C are diagrams illustrating a part of the print head according to the third embodiment. FIG. 9A is a plan view illustrating the layout of each part in the preliminary heating area of the print head substrate. FIG. 9B is a sectional view taken along line IXB-IXB of FIG. 9A. FIG. 9C is a sectional view taken along line IXC-IXC of FIG. 9A. Incidentally, in FIGS. 9A to 9C, the same reference numerals are used to refer to parts identical or equivalent to those of the first and second embodiments.

In the third embodiment, not poly-Si but a film formed of the same material as the ejection heater 103 constitutes a sub heater 405. In general, the electric resistance value of the ink ejection heater 103 per unit volume exceeds the electric resistance value of poly-Si per unit volume. Accordingly, the sub heater 405 is provided with multiple current bypass portions 208B as illustrated in FIG. 9C. Each current bypass portion 208B includes a plug 206B and a wiring portion 203B having low electric resistance as in the case of the first embodiment. In this manner, in the present embodiment, the multiple low-electric resistance current bypass portions 208B are connected in parallel to a plurality of parts of the sub heater 405. Accordingly, the electric resistance of the entire preliminary heating portion can be reduced without an increase in the area of the sub heater 405, and thus the sub heater area shrinkage effect can be achieved.

In addition, the present embodiment is configured such that the sub heater 405 is formed at a position close to the ejection heater 103, that is, the upper layer portion of the insulating layer 202 and the heating portion 209 also is arranged in the vicinity of the heater 103. As a result, the ink present in the vicinity of the ejection heater 103 can be heated at a closer position by the heating portion 209, and thus the viscosity of the ink can be more effectively reduced and the ink refill property can be improved.

Fourth Embodiment

Figure 10A:
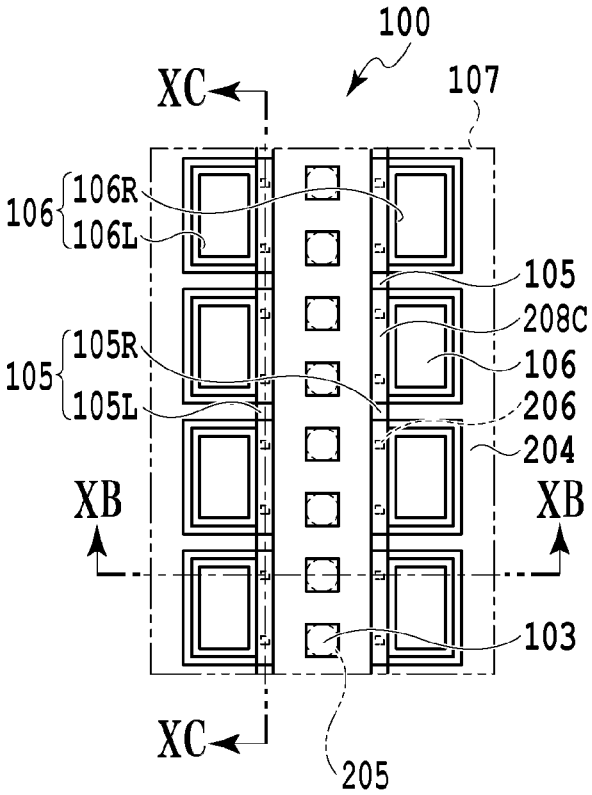
FIGS. 10A to 10C are diagrams illustrating a part of a print head according to a fourth embodiment.
Figure 10C:
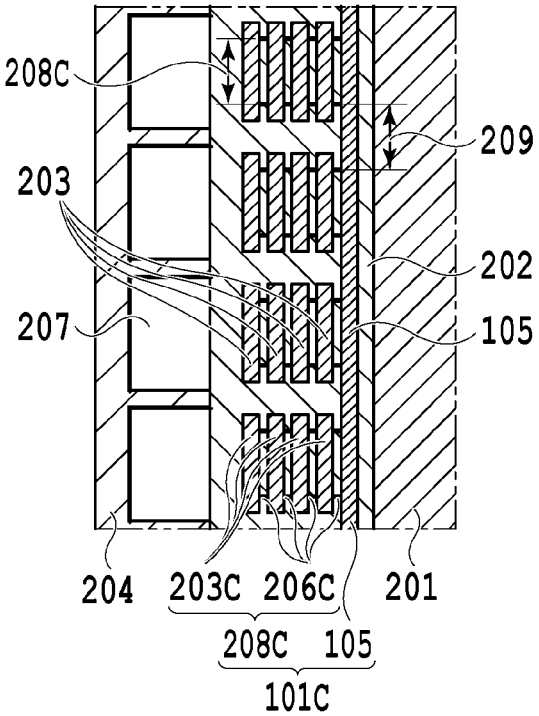
Figure 10B:
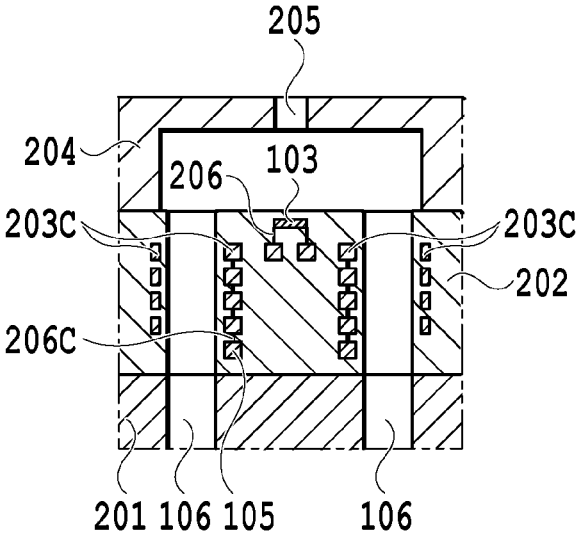

A fourth embodiment of the invention will be described below. FIGS. 10A to 10C are diagrams illustrating a part of the print head according to the fourth embodiment. FIG. 10A is a plan view illustrating the layout of each part in the preliminary heating area of the print head substrate. FIG. 10B is a sectional view taken along line XB-XB of FIG. 10A. FIG. 10C is a sectional view taken along line XC-XC of FIG. 10A. Incidentally, in FIGS. 10A to 10C, the same reference numerals are used to refer to parts identical or equivalent to those of the first and second embodiments.

In the fourth embodiment, a preliminary heating portion 101C as illustrated in FIG. 10C is formed in the plurality of preliminary heating areas set in the print head substrate 100. The preliminary heating portion 101C includes the sub heater 105 and a plurality of current bypass portions 208C connected in parallel to a plurality of places in the sub heater 105. The heating portion 209 is formed between the plurality of current bypass portions 208C. The current bypass portion 208C includes wiring portions 203C as multiple layers formed in an annular shape along the circumference of the ink supply ports 106 (106L and 106R) formed to the left and right of the ejection heater 103 and a plug 206C electrically connecting each wiring portion 203C. A1 wiring constitutes each wiring portion 203C.

As described above, in the fourth embodiment, the heat that is generated from the heating portion 209 of the sub heater 105 is transferred to the plugs 206C and the low-thermal resistance annular wiring portions 203C and the ink passing through the ink supply port 106 positioned in the tubular region surrounded by the wiring portion 203C is heated as a result. Accordingly, the viscosity of the ink passing through the ink supply port 106 is reduced and the property of ink refill on the ejection heater 103 is improved.

Especially in the present embodiment, heating is performed with the circumference of the ink supply port 106 completely covered, and thus ink heating can be more efficiently performed than in the second embodiment illustrated in FIGS. 8A to 8C. Here, depending on the viscosity, type, and so on of the ink that is heated, a partially broken (such as C-shaped) wiring portion may be formed instead of the wiring portion 203C that is completely annular as in the present embodiment. As a matter of course, also in this case, the wiring portion needs to be connected to the sub heater 105 with the plug such that a current bypass portion is formed.

Incidentally, in the second embodiment described above, the ink in the vicinity of the ejection port 205 is heated by the upper layer portion of the wiring portion 203A, and thus ink concentration attributable to moisture evaporation from the ejection port 205 may occur in a case where a heated state continues without ink ejection. According to the configuration of the fourth embodiment, in contrast, the ink that passes through the ink supply port is heated, and thus the risk of ink concentration can be reduced and the ink in the vicinity of the ejection heater 103 can be kept in a state more suitable for ejection.

Although the sub heaters 105 are linearly arranged in the example illustrated in FIGS. 10A to 10C, the sub heaters 105 can also be arranged such that the ink supply ports 106 are surrounded. Furthermore, although poly-Si constitutes the sub heater 105 in the embodiments described above, the sub heater 105 may also be formed of the same material as the ejection heater 103.

Other Embodiment

The liquid ejection head provided with the liquid ejection head substrate according to the invention is applicable to various liquid ejection devices. In other words, the liquid ejection head provided with the liquid ejection head substrate according to the invention is applicable to a so-called serial scan type liquid ejection device applying a liquid to a print medium or an ejection object medium by moving the liquid ejection head in a main scanning direction while ejecting ink. In addition, the liquid ejection head may be configured by a plurality of the liquid ejection head substrates illustrated in FIG. 1A being arranged in the X direction.

The invention is also applicable to liquid ejection devices other than serial scan type liquid ejection devices. For example, the invention is also applicable to a so-called full line type liquid ejection device holding a long liquid ejection head corresponding to the width of a print medium or an ejection object medium and applying a liquid to the print medium or a print target medium while continuously moving the print medium or the print target medium in the direction crossing the longitudinal direction of the liquid ejection head. However, in this case, a larger number of liquid ejection head substrates should be arranged to constitute the long liquid ejection head.

In the example of the liquid ejection head substrate described above, the ejection heater 103 generating bubbles by heating ink is used as the ejection energy generating element for liquid ejection. However, the invention is not limited thereto. In other words, an electromechanical transducer such as a piezoelectric element can also be used as the ejection energy generating element.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-127791 filed Jun. 29, 2017, which is hereby incorporated by reference wherein in its entirety.

What is claimed is:

1. A liquid ejection head substrate comprising:

a base material;

an element array in which a plurality of ejection energy generating elements generating ejection energy for liquid ejection are arranged on a surface side of the base material; and a heating unit, wherein the heating unit includes a heating element extending in a direction of the element array and generating heat by being energized, wiring spaced apart from the heating element in a direction orthogonal to the surface of the base material, and a plurality of connecting portions connecting the heating element and the wiring to each other, wherein the heating element, the wiring, and the plurality of connecting portions are provided in a region overlapping a region where the element array is disposed in a direction orthogonal to the direction of the element array when seen from the direction orthogonal to the surface of the base material and a current flows to the wiring in a middle of a path of a current flowing through a heating element when the heating element is energized.

2. The liquid ejection head substrate according to claim 1, wherein the wiring is formed of a material exhibiting a lower electric resistance than the heating element when the wiring has the same length and the same width as the heating element.

3. The liquid ejection head substrate according to claim 1, wherein the heating element is continuously formed in the direction of the element array in a heating area including the plurality of ejection energy generating elements and a plurality of the wiring are connected in parallel to the heating element.

4. The liquid ejection head substrate according to claim 1, wherein the heating element is formed in a divided manner in a heating area including the plurality of ejection energy generating elements and the wiring is connected in series to the heating element formed in the divided manner.

5. The liquid ejection head substrate according to claim 1, wherein the wiring is formed at a position closer to the ejection energy generating element than the heating element.

6. The liquid ejection head substrate according to claim 1, wherein a plurality of wiring portions laminated on the surface side of the base material constitute the wiring.

7. The liquid ejection head substrate according to claim 1, further comprising a supply port for liquid supply to the ejection energy generating element, wherein the wiring is arranged such that the supply port is surrounded.

8. The liquid ejection head substrate according to claim 1, further comprising a supply port for liquid supply to the ejection energy generating element, wherein the heating element is arranged in a vicinity of a flow path reaching the ejection energy generating element from the supply port.

9. The liquid ejection head substrate according to claim 1, further comprising a plurality of heating areas including the plurality of ejection energy generating elements, wherein the heating element is provided in each of the plurality of heating areas along with driving unit for controlling driving of the heating element provided in each of the heating areas in accordance with an input control signal.

10. The liquid ejection head substrate according to claim 9, wherein the control signal is supplied from a data processing circuit disposed outside the liquid ejection head substrate.

11. The liquid ejection head substrate according to claim 9, wherein the control signal is generated by a data processing circuit disposed in the liquid ejection head substrate.

12. The liquid ejection head substrate according to claim 1, wherein a diffusion resistance material of a poly-Si or Si substrate forms the heating element and at least one of Cu, Al, Au, Ni, W, Ti, and a compound thereof forms the wiring.

13. The liquid ejection head substrate according to claim 1, wherein the connecting portion is a plug.

14. The liquid ejection head substrate according to claim 1, further comprising a supply port array in which a plurality of supply ports for liquid supply to the ejection energy generating element are arranged along the direction of the element array, wherein the heating unit is positioned between the element array and the supply port array when seen from the direction orthogonal to the surface of the base material.

15. The liquid ejection head substrate according to claim 1, wherein the heating element is connected to the wiring via the plurality of connecting portions in an end portion of the heating element in the direction of the element array.

16. The liquid ejection head comprising:

a liquid ejection head substrate including a base material, an element array in which a plurality of ejection energy generating elements generating ejection energy for liquid ejection are arranged on a surface side of the base material, and a heating unit; and an ejection port forming member including an ejection port through which a liquid is ejected by the ejection energy, wherein the heating unit has a heating element extending in a direction of the element array and generating heat by being energized, wiring spaced apart from the heating element in a direction orthogonal to the surface of the base material, and a plurality of connecting portions connecting the heating element and the wiring to each other, wherein the heating element, the wiring, and the plurality of connecting portions are provided in a region overlapping a region where the element array is disposed in a direction orthogonal to the direction of the element array when seen from the direction orthogonal to the surface of the base material, and a current flows to the wiring in a middle of a path of the current flowing through the heating element when the heating element is energized.

17. The liquid ejection head according to claim 16, wherein the wiring is formed of a material exhibiting a lower electric resistance than the heating element when the wiring has a same length and a same width as the heating element.

18. The liquid ejection head according to claim 16, wherein the heating element is continuously formed in the direction of the element array in a heating area including the plurality of ejection energy generating elements and a plurality of the wiring are connected in parallel to the heating element.

19. The liquid ejection head according to claim 16, wherein the heating element is formed in a divided manner in a heating area including the plurality of ejection energy generating elements and the wiring is connected in series to the heating element formed in the divided manner.

20. The liquid ejection head according to claim 16, wherein a plurality of wiring portions laminated on the surface side of the base material constitute the wiring.

* * * * *